United States Patent [19]

Wu et al.

[11] 4,092,940

[45] June 6, 1978

[54] SEAMER APPARATUS

[75] Inventors: Samuel Chinlun Wu, Lakewood; Stephen Alan Holick, Aurora, both of Colo.

[73] Assignee: Adolph Coors Company, Golden, Colo.

[21] Appl. No.: 803,605

[22] Filed: Jun. 6, 1977

[51] Int. Cl.[2] ..... B21D 19/00

[52] U.S. Cl. ..... 113/29; 113/114 R; 113/1 E

[58] Field of Search ..... 113/1 E, 1 G, 12, 14 R, 113/14 A, 24 R, 24 A, 24 D, 24 E, 24 EA, 24 EB, 24 EC, 24 ED, 24 F, 24 G, 24 H, 25, 27, 28, 29, 30, 114 R, 113 R, 115

[56] References Cited

U.S. PATENT DOCUMENTS

| | | | |
|---|---|---|---|
| 2,604,258 | 7/1952 | Murnane et al. | 113/120 Y X |
| 2,611,493 | 9/1952 | Nordquist | 113/115 X |
| 2,640,452 | 6/1953 | Stone | 113/115 |
| 2,680,550 | 6/1954 | Pechy | 113/30 X |
| 2,907,293 | 10/1959 | Peterson, Jr. | 113/24 R |
| 3,549,440 | 12/1970 | Adcock | 113/121 R X |

*Primary Examiner*—Leon Gilden
*Attorney, Agent, or Firm*—Klaas & Law

[57] ABSTRACT

Can seamer apparatus for fixedly sealable associating a can end member with a can body member to form a can with contents sealed therewithin comprising a lightweight control rod assembly means reciprocably mounted in a guide bore for movement between an extended position of engagement with a can end member and a retracted position of disengagement relative thereto with a resilient cushion means on one end thereof and a spring means associated therewith to provide a predetermined minimum force on the end member and having fluid flow control and discharge means associated therewith to limit axial fluid flow into and to discharge fluid from the bore circumjacent the control rod assembly.

19 Claims, 4 Drawing Figures

SEAMER APPARATUS

BACKGROUND AND SUMMARY OF THE INVENTION

This invention relates to apparatus for forming a seam between a can end member and a can body member, after the can body member has been filled with a liquid, to affix and seal the end member on the body member.

In recent years, there have been new developments in opening devices for metallic cans which are integral with metallic can end members and include "tab" type opening devices openable by axially inwardly directed forces causing axial inward movement of the tab portion relative to the end member after fracture of score groove portions connecting the opening device to the end member. Such opening devices preferably remain integrally connected to the end member after opening to preclude removal and careless disposal thereof. Such opening devices are preferably also designed to be opened by manual application of relatively low forces, e.g., 8 to 14 pounds, and preferably by directly applied manual force through the finger of a person rather than by mechanical advantage devices in order to reduce the cost of manufacture. Such an opening device is disclosed in U.S. Pat. No. 3,982,657.

The construction and arrangement of such opening devices have created problems in the manufacture of cans because of the relatively low forces required to open the devices. In conventional can manufacturing operations, a can body member and a can end member are separately constructed and then combined after the can body member has been filled with the contents to be stored within the completed can. In order to provide a can opening device which will satisfy the requirements of being openable by relatively low manually applied force, it is also necessary that suitable handling and processing methods and apparatus be devised to preclude premature opening of the opening devices during the manufacture, filling and subsequent handling of the can components and the completed can.

The present invention relates to the solution of particular problems in conventional "seamer" apparatus for the manufacture of cans which apparatus sealably affixes a can end member to a can body member filled with a fluid such as beer. The problems solved by the present invention involve not only the prevention of premature fracture of new can opening devices but also involve related and other problems associated with conventional seamer apparatus, regardless of the design of the opening devices and end members, including mounting of certain parts in a manner preventing undue wear and breakage and contamination of such parts resulting in unnecessary down time of the apparatus for repair, maintenance and cleaning.

The present invention may be summarized as comprising seamer apparatus having a lightweight control rod means with a resilient compressible cushion means on one end thereof for engaging the upper surface of an end member at various times during operation of the seamer apparatus and spring means acting in combination with the cushion means to apply only a relatively light force on the end member less than the normal manually applied opening force while nontheless providing all the requisite functions of holding and stabilizing the end member in the seamer apparatus. In addition, the control rod means is constructed and arranged to reduce wear and tear problems, to facilitate maintenance, and to reduce contamination of the apparatus.

DETAILED DESCRIPTION

In General

Figure 1:
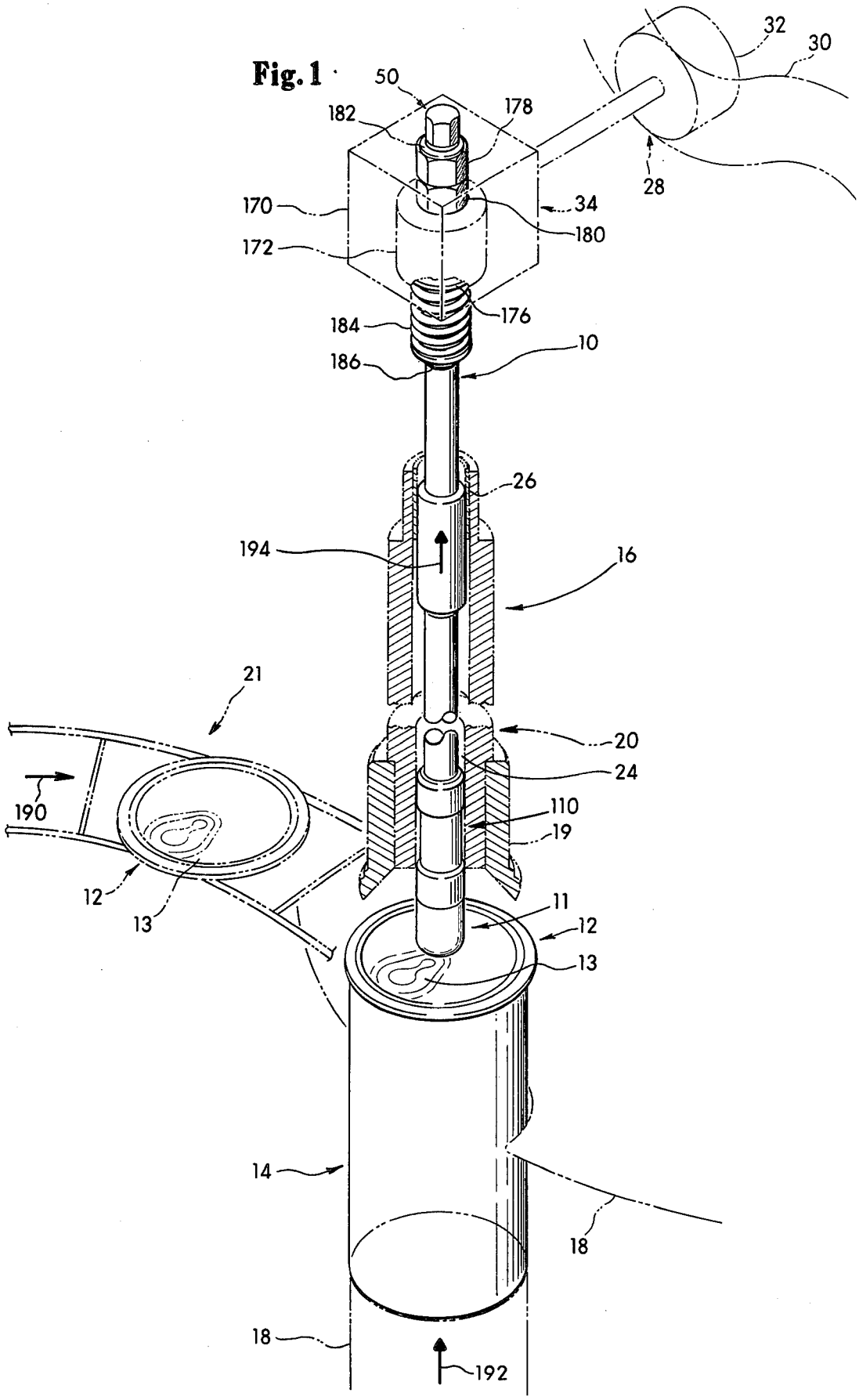
FIG. 1 is a partially schematic perspective view of apparatus for seaming a can end member to a can body member including a control rod means assembly.
Figure 3:
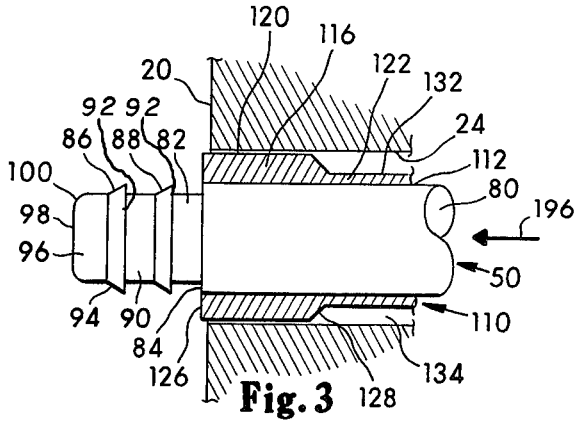
FIG. 3 is an enlarged side elevational view of one end portion of the control rod means assembly of FIG. 1 with parts removed.

Referring to FIG. 1, a presently preferred and illustrative embodiment of the invention is shown to comprise a control rod assembly means 10 mounted for controlled reciprocal movement between an upwardly displaced retracted position, FIG. 3, and a downwardly displaced extended position, FIG. 1, with a resilient cushion means 11 on the lower end thereof for engaging the upper surface of a can end member 12 having an integral opening device 13 thereon. The cushion means is engaged with the end member both prior to and after a "seaming" operation whereby the can end member is sealingly fixedly associated with the upper rim portion of the open upper end of a can body member 14 filled with a liquid such as beer.

The control rod means assembly 10 is mounted in a conventional seamer machine 16, such as made by the Angelus Sanitary Can Machine Company, by which individual end members are associated with filled individual body members, the end members are fixedly sealably associated with the body members, and the completed cans are discharged from the machine. The conventional machine components related to the present invention are schematically illustrated by broken lines and comprise body member transfer means 18, for supporting and transferring the body member from a transfer conveyor from a "filling" station (not shown), whereat the body member is filled with liquid, to a "make-up" station, FIG. 1, whereat the body member 14 is axially upwardly displaced to engage the rim portion of the can body member with the bottom surface of the rim portion of an end member 12 positioned thereabove in axial alignment therewith. Then the can body member and the end member which has been mounted thereon are further axially upwardly displaced while being transferred to a "seaming" station (not shown) whereat the end member engages a seaming chuck 19 attached to a rotatably drivably mounted seaming spindle 20, which may be rotated for rotating the can body member and end member relative to seaming dies (not shown) for fixedly sealably connecting the end members to the body members. Then the completed can is transferred to a "discharge" station (not shown) for transfer to conveyor apparatus (not shown). An end member transfer means 21, in the form of a conventional guide track and slide mechanism causes lateral movement of the end members toward the "make-up" station. The seaming spindle 20 is rotatable in unison with the transfer means 18, and provides control rod support means including a lower guide bore 24 and an upper bearing sleeve means 26 for reciprocably rotatably guidably supporting the control rod means 10. A cam means 28, in the form of a cam track 30 and a cam follower roller 32, and connecting means 34 control the reciprocal movement of the control rod means 10. The arrangement is such that resilient cushion means 11 first comes into engagement with the upper surface of the end member during association of the end member and the body member at the "make-up" station and then remains in engagement during subsequent upward movement of the can body member and the end member during transfer to the "seaming" station to locate and stabilize the end member on the can member, then is disengaged from the upper surface of the end member after initiation of and during the seaming operation, and then is re-engaged with the upper surface of the end member after the seaming operation to release the seamed can from the seaming apparatus, and then again disengaged during transfer to the discharge station.

CONTROL ROD MEANS ASSEMBLY

Figure 2:
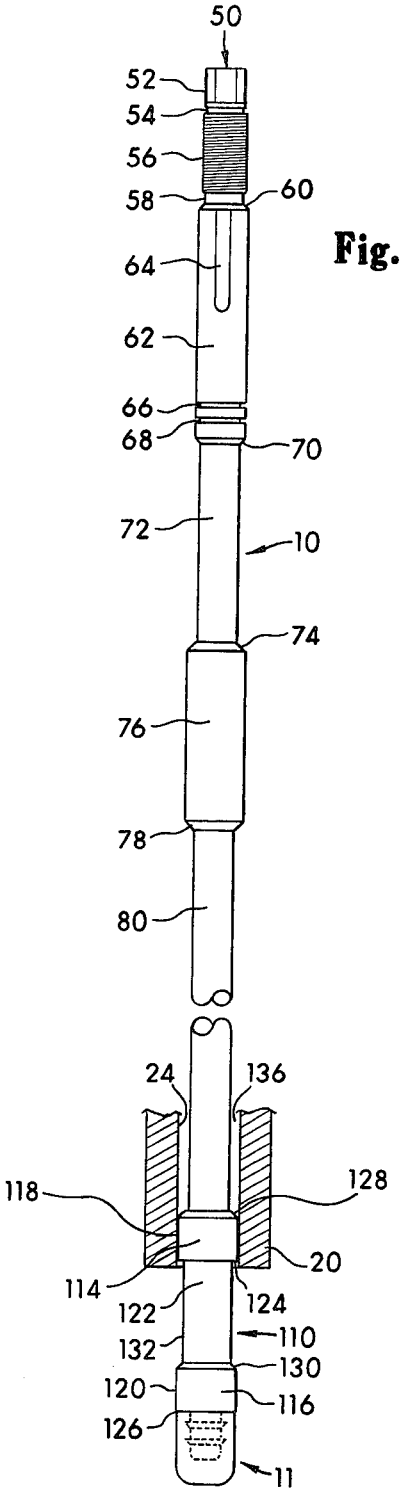
FIG. 2 is a side elevational view of the control rod means assembly of FIG. 1.

Referring to FIG. 2, the control rod means assembly 10 comprises an elongated rod member 50 of generally cylindrical cross-section made of one piece of relatively hard surfaced lightweight material such as aluminum alloy type 7075 T6 or T651 having a hard anodized surface. In the presently preferred embodiment, the rod member weighs approximately 7 ounces and should not weigh more than approximately 16 ounces whereas prior art devices had relatively heavy weights of, for example, 26 ounces.

The upper portion of rod member 50 is provided with mounting and attachment means in the form of a hexagonal head portion 52, a relatively narrow width upper cylindrical snap ring groove portion 54 having a reduced diameter of approximately 7/16 inch, a threaded portion 56, a relief portion 58 having a reduced diameter of approximately 7/16 inch, a chamfer surface 60, a cylindrical mounting portion 62 of relatively large diameter of approximately 0.584 inch, an axially extending keyway 64 in portion 62, first and second lower axially spaced cylindrical snap ring grooves 66, 68 in portion 62, a chamfer surface 70, a relatively short length elongated intermediate connected portion 72 having a reduced diameter of approximately 7/16 inch, a chamfer surface 74, a cylindrical guide portion 76 of maximum diameter of approximately 0.621 inch, and a chamfer surface 78. The lower portion of rod member 50 is provided with a relatively long length elongated intermediate connecting portion 80 having a reduced diameter of approximately 7/16 inch, a relatively short intermediate connecting portion 82, FIG. 3, of approximately 0.330 inch diameter and 0.115 inch length providing a transverse annular shoulder 84, a pair of axially spaced retaining flange portions 86, 88 separated by a relatively short intermediate connecting portion 90 having a reduced diameter of approximately 0.330 inch and each including an upwardly facing annular transversely extending abutment surface 92 of approximately 0.415 inch diameter and an inclined annular surface 94, FIG. 3, and a terminal portion 96 having a diameter of approximately 0.330 inch and a flat transverse end surface 98 with a rounded peripheral surface 100.

A guide and sealing sleeve means 110, FIGS. 2 & 3, is fixedly mounted on the lower end portion of rod member 50 for slidably guideably reciprocably supporting the lower end portion of the control rod assembly means 10 in the bore 24 and for limiting entry of excess overflow fluid, commonly present in the machine from the filling operation, into the bore 24 while also limiting retention of fluid in the bore which can otherwise harden and adversely affect the operation. In the presently preferred embodiment, the sleeve means 110 is made of one piece of stainless steel tubing material. The sleeve means comprises a central bore 112 having a diameter of approximately 0.439 inch so as to be shrink fitted on the lower end of the intermediate portion 80 of the rod member in fixed relationship relative thereto.

The sleeve means 110 further comprises a pair of axially spaced terminal portions 114, 116 having cylindrical guide surfaces 118, 120 of approximately 0.622 inch and connected by an intermediate cylindrical portion 122 of reduced diameter of approximately 0.50 inch. The terminal portions have flat transverse annular downwardly facing surfaces 124, 126, with surface 126 being substantially axially aligned with shoulder surface 84, and chamfered upwardly facing surfaces 128, 130. The arrangement is such as to provide fluid flow control and discharge means in the form of an annular elongated groove 132 between surfaces 126 and 128 which in association with the wall of bore 24, which has a diameter of approximately 0.625 inch, in the assembled position defines a first variable volume fluid collection chamber means 134. Furthermore, the flat transverse surface 124 acts as a piston means for forcing fluid downwardly during downward movement of the rod member while acting as a barrier to upward flow of fluid in the downwardly extended position of FIG. 1. In addition, the reduced diameter and relatively long length of rod portion 80 provide a second variable volume fluid collection chamber means 136 which in combination with the chamfered surface 128 and the pressure differential caused by the piston-like motion of surface 124 facilitates downward flow of fluid from chamber 136.

Figure 4:
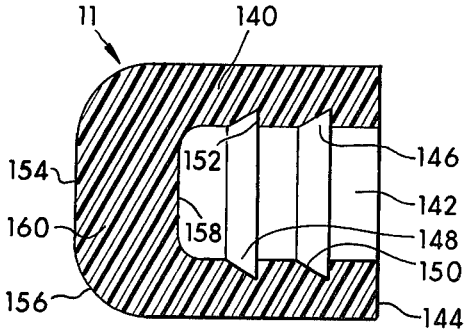
FIG. 4 is a further enlarged cross-sectional side elevational view of a cushion means shown in FIGS. 1 and 2.

Referring now to FIG. 4, in the presently preferred embodiment, the resilient cushion means 11 comprises one piece of molded resilient compressible relatively soft plastic material such as high temperature urethane having a durometer of between 55 and 65 on the A scale. The cushion means 11 further comprises a cylindrical body member 140 having an internal bore 142, with a diameter of approximately 0.325 inch, so as to be resiliently compressible about rod portions 82, 90, 96, extending through a transverse rear surface 144 and provided with retaining means in the form of a pair of axially spaced flange cavities 146, 148, each of which has an inclined outer surface 150 extending outwardly of the bore surface to provide a downwardly facing annular shoulder surface 152 having a diameter of approximately 0.410 inch so as to be undersized relative to flange portions 86, 88 and resiliently compressible thereabout. The surfaces 152 are axially spaced from surface 144 distances of approximately 0.125 inch and 0.313 inch, respectively, to cause compressive engagement on and between surfaces 84, 92, 98, 126. Cushion member 140 has a flat annular front surface 154 of relatively large, approximately 0.225 inch, diameter and a relatively large radius curved edge surface 156 with front surface 154 axially spaced from the end surface 158 of bore 142 a substantial distance such as to provide a relatively thick, e.g., approximately 0.237 inch, resiliently compressible end wall portion 160 which is of sufficient thickness to enable suitable resilient compression thereof.

The arrangement and construction is such that cushion means 11 is resiliently compressibly sealably mounted on all surfaces of the lower end portion of the rod member 50 in a manner preventing loosening during usage and preventing entry of fluid but enabling relative rotation under excess force as may be encountered during the seaming operation and enabling relatively easy mounting and removal for replacement in situ on the machine. In addition, the surface 154 is sufficiently wide and the wall portion 160 is sufficiently thick and soft to enable full surface engagement with the upper surface of the end member whereby axially applied forces are fully distributed over the entire surface 154 to prevent force concentrations which might fracture the opening device.

Referring now to FIG. 1, the cam connecting means 34 comprises a connecting block member 170 having roller bearing 172 therewithin for slidably guidably rotatably receiving cylindrical mounting portion 62 of rod member 50. A bearing lock washer member 176, including a tab portion (not shown), is mounted below the bearing unit 172 with the tab portion located in the keyway slot 64. A pair of jam nuts 178, 180 are mounted on threaded portion 56 above the bearing member 172 and tightened against one another to provide stop means limiting downward axial movement of the rod member 50 relative to the connecting block member 170. A snap ring member 182 is mounted in groove portion 54 to retain the jam nuts on the threaded portion 56 if they should work loose from each other. The use of a snap ring member 182 has proven more effective than cotter pins which are more apt to break in operation of the apparatus.

The connecting means 34 further comprises a spring means 184 in the form of a compression spring mounted circumjacent portion 62 of rod member 50 with one end abutting the lockwasher member 176 and the other end abutting a snap ring 186 fixedly mounted in one or the other of the snap ring grooves 66, 68. The arrangement of the spring is such as to provide spring means for downwardly biasing the rod member 50 relative to the connecting block member 170 to tend to locate the rod member and the resilient cushion means 11 in a fully downwardly extended position and for further absorbing upwardly directed forces on the rod member.

The spring means provides a relatively low spring force (rate) of between approximately 4 to 20 pounds per inch and, preferably, approximately 8 pounds per inch whereas, in prior apparatus, relatively high spring forces of approximately 30 to 42 pounds per inch have been utilized. The arrangement is such that during normal operation the spring deflection is approximately $\frac{3}{8}$ to $\frac{3}{4}$ inch. The arrangement further provides force adjustment means in that the amount of force exerted by the spring 184 may be varied by the location of the snap ring 186 with maximum force being provided when the snap ring is mounted in groove 66 and minimum force being provided when mounted in groove 68. If necessary or desired, additional grooves may be provided and more finite adjustment could be provided by a threaded nut (not shown) on a threaded lower portion (not shown) of rod portion 62.

In the presently preferred embodiment, the construction and arrangement of the control rod means 10, the cushion means 11, and the spring means 184 is such that forces applied to the central upper surface of the end member 12 through surface 154 of the cushion means 11 are limited to approximately no more than a maximum of 6 to 8 pounds and preferably 2 to 3 pounds so as to preclude application of force sufficient to cause damage to the opening device 13 on the end member.

OPERATION

The position of the rod means assembly 10 is controlled by the cam means 28 so that, prior to reaching the "make-up" station, the rod member 50 is fully extended. The end member 12 moves laterally along the guide track means 21 as indicated by arrow 190 to the "make-up" station and the filled body member is transferred to the "make-up" station in a manner causing axial displacement toward the end member, as indicated by arrow 190. At that "make-up" station, the end member 12, body member 14, and rod means 10 all come together and the end member 12 is seated on the open upper end rim portion of the can body member 14 with the cushion means 11 of the rod means 10 lightly engaging the central portion of the top surface of the end member 12 to hold and stabilize the end member on the body member. The cam means 28 may alternately be adjusted so that the cushion means 11 engages the end member 12 before the "make-up" station to hold and stabilize the end member during its lateral movement 190, along the guide track means 20. Simultaneously with the engagement of the body member 14 with the end member 12, the cam means 28 is effective to begin upward retracting movement of the control rod 50, as indicated by arrow 194, to maintain a constant axially spaced relationship relative to the body member during the continued upward movement thereof and to maintain only light force on the end member sufficient to stabilize the end and body members and to hold the end member on the rim portion of the body member. At the "seamer" station, the cam means 28 is effective to continue engagement with the end member until after the seaming operation has begun and then to cause upward movement of the control rod member to leave the end member supported on the open end rim portion of the body member in downwardly spaced relationship to the cushion means 11. After the seaming operation is completed, the cam means 28 is effective to again cause downward movement of the control rod 50 from the retracted position of FIG. 3 as indicated by arrow 196, to the extended position, FIG. 1, to re-engage the cushion means 11 with the central upper surface of the end member then affixed to the body member to remove (knock-out) the seamed rim portions from the seamer dies by relatively light force engagement therebetween. After the seaming operation, the pressure in the sealed can is effective to increase the force required to fracture the opening device. The completed can is then transferred from the "seamer" station to a "discharge" station and the cushion means 11 is disengaged from the end member with the cam means 28 being effective to again return the control rod 50 to the initial retracted position.

The spring means 184 is constructed and arranged so as to continually bias the control rod 50 and the cushion means 11 toward a fully downwardly extended position. As the cushion means 11 engages the upper surface of an end member during downward movement of the control rod 50, the cushion means is effective to provide a soft light force initial engagement. The spring means 184 is effective to permit axial upward movement of the control rod relative to the cam connecting means 34 if an axially misaligned can end is encountered or to prevent bending or destruction of the control rod 50 and connecting means 34 if a can body or end should become misaligned or jammed between the transfer means 18 and the control rod 50. During both initiation of engagement and disengagement, compression forces in the cushion means 11 and, if encountered, the spring means 184 are effective to cause relatively slow gradual gentle engagement and disengagement of cushion means 11 relative to the end member so as not to cause destabilization or to adversely affect the stabilized condition of the end member on the body member obtained during transfer from the "make-up" station to the "seamer" station. The use of lightweight material for rod member 50 reduces inertial forces and impact forces at the time of contact with the end member.

The construction and arrangement of the control rod assembly means 10 is also such that axial upward flow of excess fluid in bore 24 is substantially reduced and retention of fluid in bore 24 is substantially eliminated. The reduced diameter portion 132 of sleeve member 110 provides a first relatively small variable volume fluid collection chamber 134 from which excess fluid is repeatedly expelled by surface 124. In addition, reduced diameter portion 80 of control rod member 50 provides a second relatively large variable volume fluid collection chamber 136 from which excess fluid is readily downwardly displaced by pressure differentials resulting from the downward pumping action of surface 124, the chamfer surface 128, the chambers 134, 136.

While the presently preferred illustrative embodiment of the invention heretofore described provides particularly advantageous results in connection with a particular type of end member and a particular type of seamer apparatus, it is contemplated that the invention may be used for other types of end members and/or with other types of seamer apparatus. Thus, it is intended that the following claims be construed to include various alternative embodiments of the invention except insofar as limited by the prior art.

We claim:

1. In apparatus for seaming a can end member on a can body member and comprising:

end member transfer means for causing movement of an end member to a "make-up" station;

can body member transfer means for causing movement of a can body member to the "make-up" station and for effecting supportive engagement of the can body member with the can end member and for causing movement of the can body member and the end member supported thereby from the "make-up" station to a "seamer" station;

control rod means for applying a relatively light holding and stabilizing force on said end member during supportive association of the body member with the end member at the "make-up" station and during movement of the can body member and the end member supported thereby from the "make-up" station to the "seamer" station;

cam means operatively connected to said control rod means for causing movement of said control rod means between an extended position and a retracted position relative to the end member; and the improvement of resilient compressible force application controlling means mounted on said control rod means for engaging the upper surface of the end member and limiting the amount of force applied to the end member.

2. The invention defined in claim 1 and wherein said force application controlling means comprising a resilient cushion member mounted on the end of said control rod means.

3. The invention as defined in claim 2 and wherein said force application controlling means further comprising a spring means operatively associated with said control rod means to bias said control rod means toward the extended position and to enable upward displacement of said control rod means against the bias of said spring means.

4. The invention as defined in claim 3 and wherein said force application means being constructed and arranged to limit force application to the end member to less than 8 pounds.

5. The invention as defined in claim 4 and wherein said resilient cushion means comprising a one-piece member made of relatively soft molded plastic material.

6. The invention as defined in claim 5 and wherein said control rod means comprising a one piece elongated metallic rod member made of relatively lightweight material and having a weight of less than 16 ounces.

7. The invention as defined in claim 6 and wherein said control rod means further comprising:

a cylindrical lower end portion; and flange means on said lower end portion having a diameter greater than said cylindrical portion;

said cushion means having an axial bore with a diameter such as to be resiliently compressibly received on and held by said cylindrical portion; and said cushion means having groove means connected to said bore and extending radially relative thereto and having a peripheral surface of smaller diameter than said flange means for being resiliently compressibly retained thereon.

8. The invention as defined in claim 1 and wherein said control rod means further comprising:

fluid flow control and discharge means adjacent said lower end portion of said rod member for limiting fluid flow into a guide bore supporting the lower end portion and for discharging fluid from the guide bore.

9. The invention as defined in claim 8 and wherein said fluid flow control and discharge means comprising:

a first variable volume fluid collection chamber means between said control rod member and the guide bore next adjacent said cushion means for collection of fluid entering the guide bore;

pump means in said chamber means for forcing fluid downwardly out of said first collection chamber during downward movement of said control rod member from the retracted position to the extended position;

a second variable volume fluid collection chamber means located axially upwardly from said first chamber means for collecting fluid entering the guide bore and flowing upwardly beyond said first chamber means; and flow control means associated with said second chamber means for causing downward flow of fluid from said second chamber means to said first chamber means during upward movement of said control rod from the extended position to the retracted position.

10. The invention as defined in claim 9 and wherein said fluid flow control discharge means further comprising:

a sleeve member made of relatively hard metallic material and being fixed on said rod member adjacent said lower end portion of said rod member, a first enlarged cylindrical portion of said sleeve member located next adjacent said lower end portion of said rod member and having a first transverse downwardly facing abutment surface engaging and supporting cushion means, and having a diameter approximately equal to the diameter of the guide bore;

a reduced diameter intermediate cylindrical portion of said sleeve member located next adjacent said first enlarged cylindrical portion and extending upwardly relative thereto and having a diameter substantially less than the diameter of the guide bore;

a chamfer surface connecting said first enlarged cylindrical portion and said intermediate cylindrical portion;

a second enlarged cylindrical portion next adjacent said intermediate cylindrical portion having a diameter approximately equal to the diameter of the guide bore and having a second transverse downwardly facing abutment surface intersecting said intermediate cylindrical portion; and said second transverse abutment surface providing a moving surface located in the guide bore to force liquid therebelow outwardly of the bore during movement of said control rod means toward the extended position.

11. The invention as defined in claim 3 and further comprising:

spring force adjustment means on said control rod means for variably adjusting the deflection of said spring means.

12. The invention as defined in claim 1 and wherein said control rod means further comprising:

an upper threaded end portion;

an enlarged cylindrical mounting portion downwardly adjacent said threaded end portion;

cam connecting means mounted on said mounting portion for connecting said control rod means to said cam means;

a pair of jam nut members mounted on said threaded end portion and holding said connecting means on said mounting portion; and snap-ring means mounted on said rod means above said jam nut members for securing said jam nut members on said threaded end portion.

13. The invention as defined in claim 11 and wherein said spring means comprising:

snap ring means mounted on said control rod member below and in axially downwardly spaced relationship to said connecting means;

a compression spring member mounted circumjacent said control rod member beneath said connecting means and above said snap ring means;

an upper end portion of said spring member being operatively supportively associated with and confined by said connecting means;

a lower end portion of said spring member being operatively supportively associated with and confined by said snap ring means; and said snap ring means comprising:

at least two axially spaced snap ring mounting grooves on said control rod member; and a snap ring member mountable in one of said grooves to apply maximum spring force to said control rod member and mountable in the other of said grooves to apply minimum spring force to said control rod member.

14. In apparatus for seaming a can end member on a can body member and comprising:

end member transfer means for causing movement of an end member to a "make-up" station;

can body member transfer means for causing movement of a can body member to the "make-up" station and for effecting supportive engagement of the can body member with the can end member and for causing movement of the can body member and the end member supported thereby from the "make-up" station to a "seamer" station;

control rod means for applying a holding and stabilizing force on said end member during supportive association of the body member with the end member at the "make-up" station and during movement of the can body member and the end member supported thereby from the "make-up" station to the "seamer" station;

guide bore means for slidably supporting a lower end portion of said control rod means;

cam means operatively connected to said control rod means for causing movement of said control rod means in said guide bore means between an extended position and a retracted position relative to the end member; and the improvement of fluid flow control and discharge means adjacent the lower end portion of said rod member for limiting fluid flow into said guide bore means and for supporting the lower end portion and for discharging fluid from said guide bore means.

15. The invention as defined in claim 14 and wherein said fluid flow control and discharge means comprising:

a first variable volume fluid collection chamber means between said control rod member and the guide bore next adjacent said cushion means for collection of fluid entering the guide bore;

pump means in said chamber means for forcing fluid downwardly out of said first collection chamber during downward movement of said control rod member from the retracted position to the extended position;

a second variable volume fluid collection chamber means located axially upwardly from said first chamber means for collecting fluid entering the guide bore and flowing upwardly beyond said first chamber means; and flow control means associated with said second chamber means for causing downward flow of fluid from said second chamber means to said first chamber means during upward movement of said control rod from the extended position to the retracted position.

16. The invention as defined in claim 15 and wherein said fluid flow control discharge means further comprising:

a sleeve member made of relatively hard metallic material and being fixed on said rod member adjacent said lower end portion of said rod member, a first enlarged cylindrical portion of said sleeve member located next adjacent said lower end portion of said rod member and having a first transverse downwardly facing abutment surface and having a diameter approximately equal to the diameter of the guide bore means;

a reduced diameter intermediate cylindrical portion of said sleeve member located next adjacent said first enlarged cylindrical portion and extending upwardly relative thereto and having a diameter substantially less than the diameter of the guide bore means;

a chamfer surface connecting said first enlarged cylindrical portion and said intermediate cylindrical portion;

a second enlarged cylindrical portion next adjacent said intermediate cylindrical portion having a diameter approximately equal to the diameter of the guide bore means and having a second transverse downwardly facing abutment surface inersecting said intermediate cylindrical portion; and said second transverse abutment surface providing a moving surface located in the guide bore means to force liquid therebelow outwardly of the guide bore means during movement of said control rod means toward the extended positon.

17. The invention as defined in claim 16 and further comprising:

the improvement of resilient compressible force application controlling means mounted on the lower end of said control rod means for engaging the upper surface of the end member and limiting the amount of force applied to the end member.

18. The invention defined in claim 17 and wherein said force application controlling means comprising a resilient cushion member mounted on the end of said control rod means.

19. The invention as defined in claim 18 and wherein:

said cushion member being mounted in engaging and supporting relationship relative to said first transverse downwardly facing abutment surface.

* * * * *